US007826768B2

(12) United States Patent
Ishikawa

(10) Patent No.: US 7,826,768 B2
(45) Date of Patent: Nov. 2, 2010

(54) CARTRIDGE AND IMAGE FORMING DEVICE

(75) Inventor: Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 428 days.

(21) Appl. No.: 12/047,653

(22) Filed: Mar. 13, 2008

(65) Prior Publication Data

US 2008/0240776 A1 Oct. 2, 2008

(30) Foreign Application Priority Data

Mar. 28, 2007 (JP) ..... 2007-083508

(51) Int. Cl.
*G03G 15/00* (2006.01)
*G03G 21/16* (2006.01)
*G03G 21/18* (2006.01)

(52) U.S. Cl. ..... 399/114; 399/25; 399/107; 399/110; 399/111

(58) Field of Classification Search ..... 399/25, 399/110, 113, 114
See application file for complete search history.

(56) References Cited

U.S. PATENT DOCUMENTS 6,032,002 A * 2/2000 Yokomori et al. ..... 399/12
6,661,977 B1 * 12/2003 Kubota ..... 399/12
6,876,826 B2 * 4/2005 Noda et al. ..... 399/90
7,194,220 B2 * 3/2007 Sasaki et al. ..... 399/90
7,203,442 B2 * 4/2007 Matsubara et al. ..... 399/90
7,212,770 B2 * 5/2007 Konishi ..... 399/114
7,428,386 B2 * 9/2008 Itabashi ..... 399/12
2002/0031359 A1 * 3/2002 Karakama et al. ..... 399/25
2002/0131790 A1 * 9/2002 Sato et al. ..... 399/111
2005/0169664 A1 * 8/2005 Arimitsu et al. ..... 399/111

FOREIGN PATENT DOCUMENTS

JP 10-069140 3/1998
JP 2000-010456 1/2000
JP 2005-181628 7/2005

OTHER PUBLICATIONS

Notification of Reason for Refusal received for corresponding Japanese Application No. 2007-083508 mailed Mar. 5, 2009.

* cited by examiner

*Primary Examiner*—David M Gray
*Assistant Examiner*—Francis Gray
(74) *Attorney, Agent, or Firm*—Banner & Witcoff, Ltd

(57) ABSTRACT

A cartridge according to one aspect of the invention is detachably attachable to a main body including a first terminal. The cartridge comprises: a case; a memory device configured to store information concerning the cartridge; a cover member configured to cover a part of the case and movably supported on the case to allow a relative movement to the case; and a second terminal provided at the cover member and electrically connected to the memory device. In a state where the cartridge is attached to the main body, the second terminal contacts with the first terminal of the main body.

20 Claims, 5 Drawing Sheets

CARTRIDGE AND IMAGE FORMING DEVICE

CROSS-REFERENCE TO RELATED APPLICATIONS

This application is based upon and claims the benefit of priority from Japanese Patent Application No. 2007-083508, filed on Mar. 28, 2007, the entire contents of which are incorporated herein by reference.

TECHNICAL FIELD

This invention relates to an image forming device, such as a laser printer, and a cartridge detachably attachable thereto.

BACKGROUND

An image forming device, such as a laser printer, generally includes a main body to which a cartridge detachably attachable.

As an example of such a cartridge, JP-A-10-069140 discloses a process cartridge described including a process cartridge connector having an electric device such as IC memory so that necessary information can be input/output to/from the IC memory. The process cartridge connector is exposed so that a connection terminal faces downward. When the process cartridge is attached to the main body, the process cartridge connector is connected to a main body connector. Accordingly, information is transferred between the IC memory and the main body.

In the process cartridge described in JP-A-10-069140, as the process cartridge connector is connected to the main body connector, attachment of the process cartridge to the main body is complete and thus abutment pressure from the main body connector acts directly on the process cartridge. In this case, the attachment position of the process cartridge to the main body may shift.

SUMMARY

One aspect of the invention has an object to provide a cartridge capable of being reliably positioned to a main body without affecting connection of a first terminal and a second terminal, and an image forming device to which the cartridge is detachably attachable.

According to an aspect of the invention, there is provided a cartridge detachably attachable to a main body including a first terminal, said cartridge comprising: a case; a memory device configured to store information concerning the cartridge; a cover member configured to cover a part of the case and movably supported on the case to allow a relative movement to the case; and a second terminal provided at the cover member and electrically connected to the memory device, wherein, in a state where the cartridge is attached to the main body, the second terminal contacts with the first terminal of the main body.

According to another aspect of the invention, there is provided an image forming device comprising: a first terminal; and a main body to which a cartridge is detachably attachable, wherein the cartridge comprises: a case; a memory device configured to store information concerning the cartridge; a cover member configured to cover a part of the case and movably supported on the case to allow a relative movement to the case; and a second terminal provided at the cover member and electrically connected to the memory device, wherein, in a state where the cartridge is attached to the main body, the first terminal contacts with the second terminal of the cartridge.

BRIEF DESCRIPTION OF THE DRAWINGS

FIG. 5A shows the developer cover positioned at a cover position and FIG. 5B shows the developing cover positioned at an exposure position.

DESCRIPTION

1. General Configuration of Laser Printer

Figure 1:
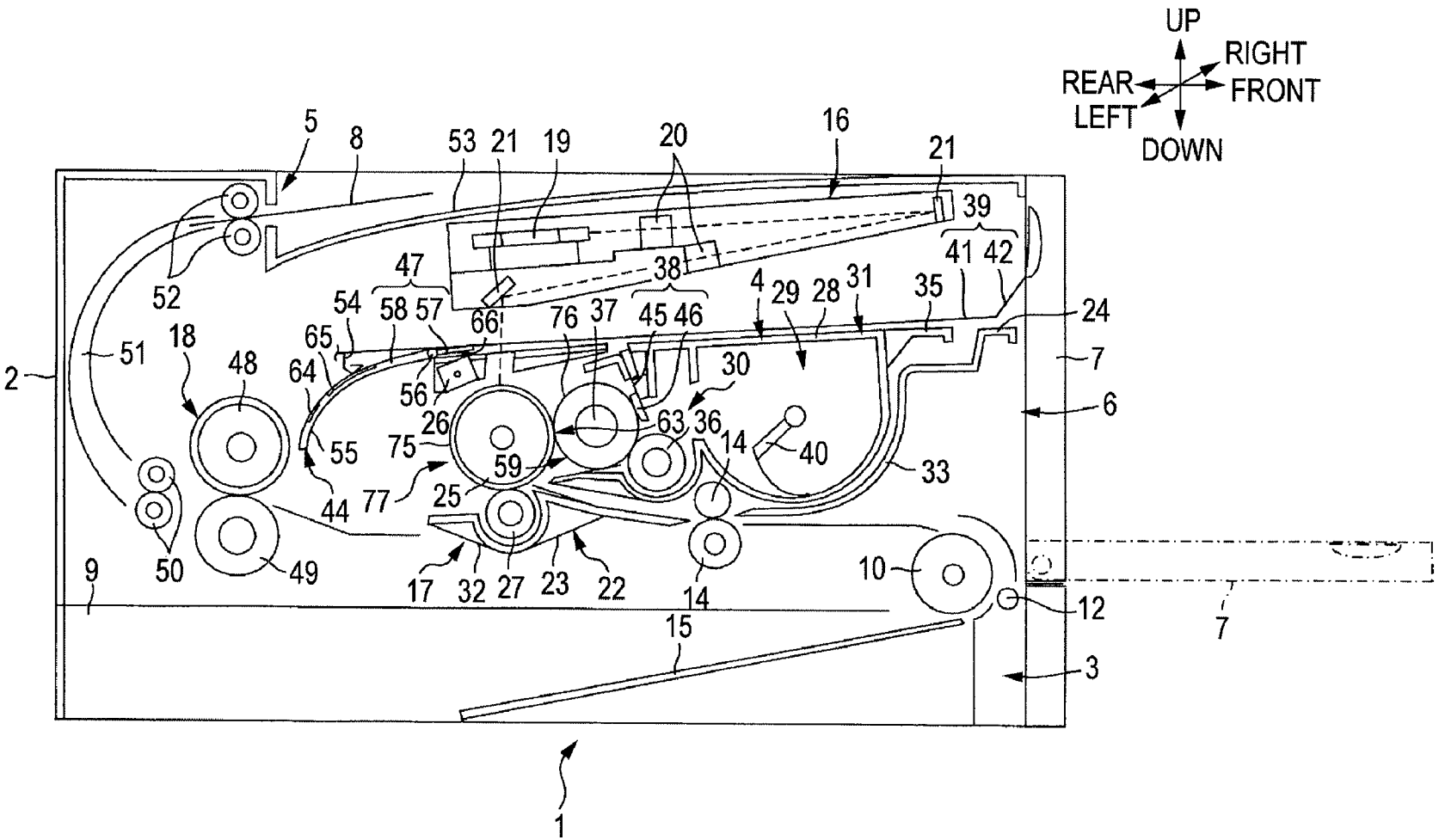
FIG. 1 is a cross-sectional side view to show a laser printer as an example of an image forming device according to one embodiment of the invention.
Figure 2:
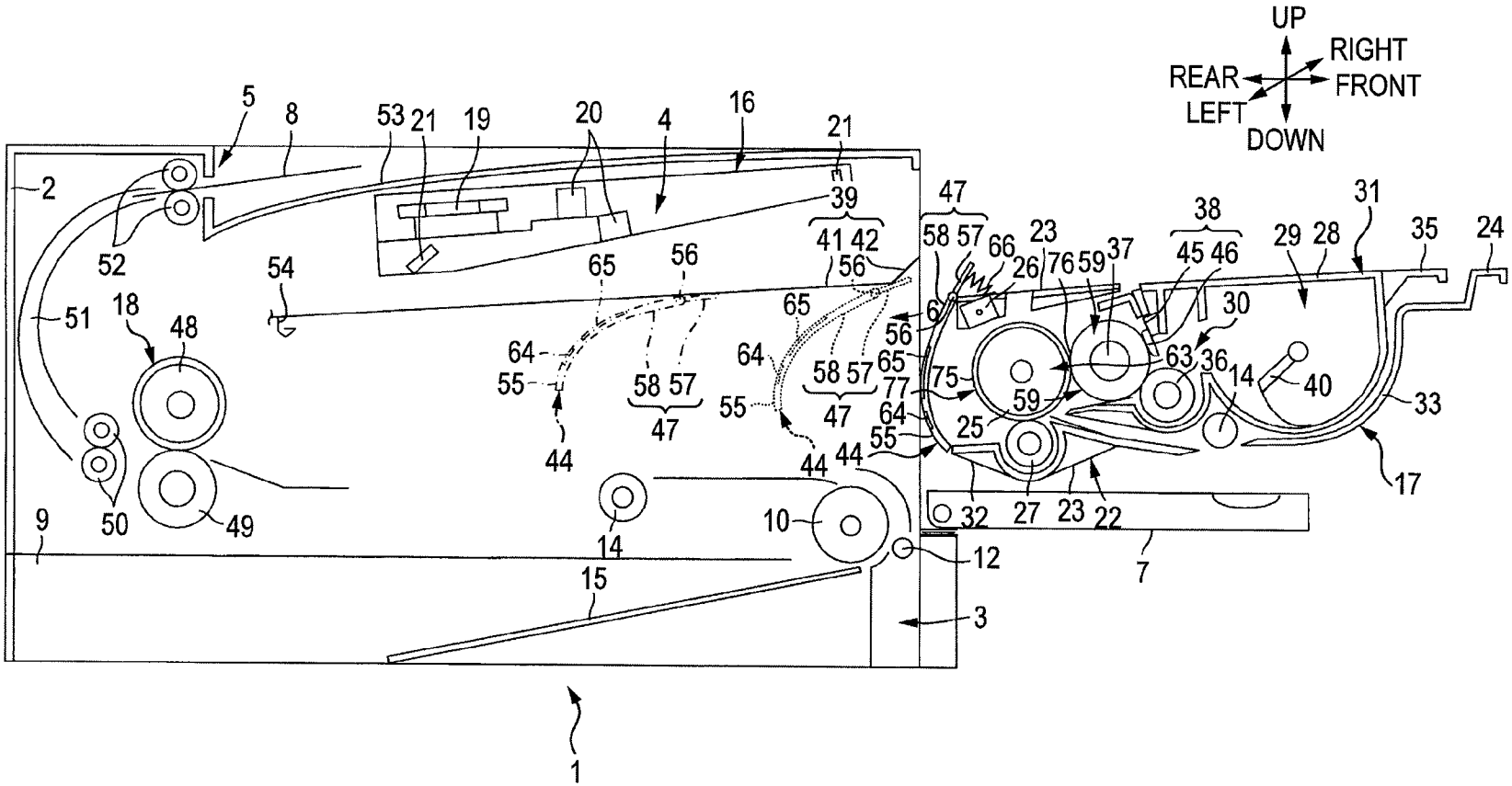
FIG. 2 shows the laser printer shown in FIG. 1 in which a process cartridge is attached to and detached from a main body casing as an example of a main body.
Figure 3:
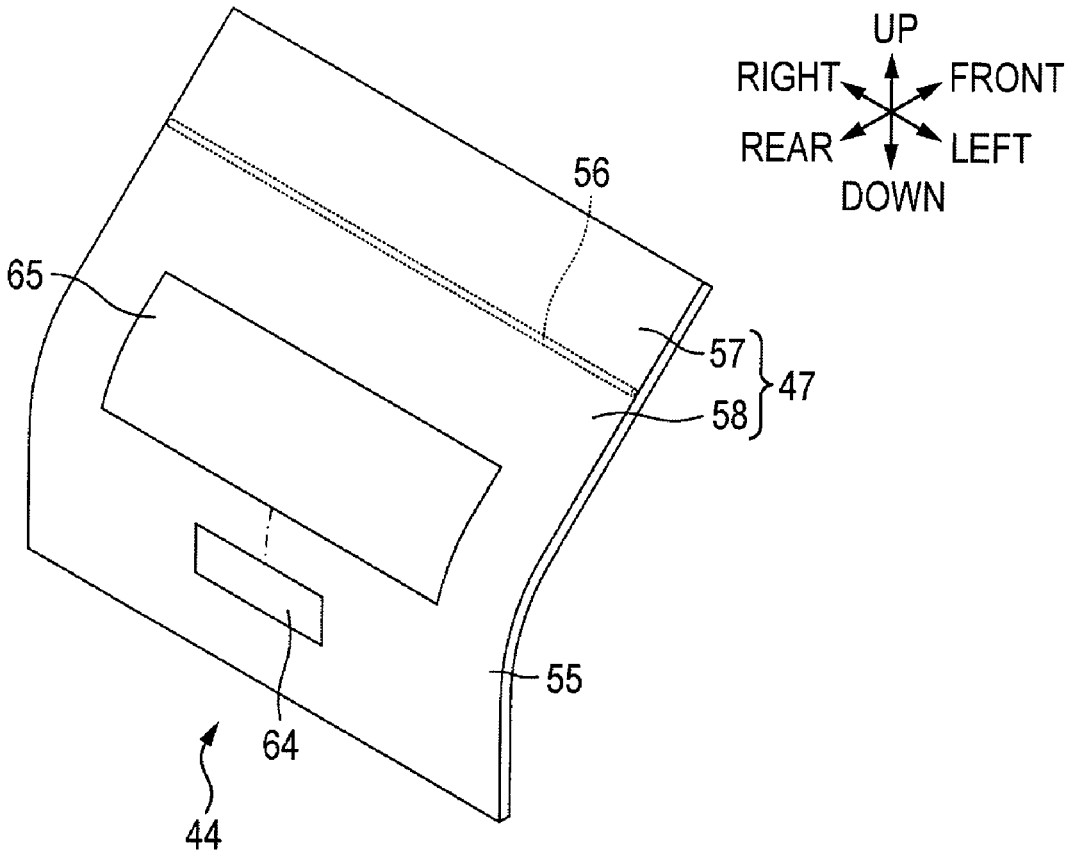
FIG. 3 is a perspective view of a drum shutter.

FIG. 1 is a cross-sectional side view to show a laser printer as an example of an image forming device according to one embodiment of the invention. FIG. 2 shows the laser printer shown in FIG. 1 in which a process cartridge is attached to and detached from a main body casing as an example of a main body. FIG. 3 is a perspective view of a drum shutter.

A laser printer 1 includes a main body casing 2 and a sheet feed unit 3, an image formation unit 4, and a sheet discharge unit 5 provided in the main body casing 2 as shown in FIG. 1.

(1) Main Body Casing

The main body casing 2 has a substantially box shape and has an opening 6 formed through one side wall of the main body casing 2. The main body casing 2 includes a front cover 7 configured to open and close the opening 6. In a state where the front cover 7 is opened, a process cartridge 17 (described later) can be attached to or detached from the main body casing 2.

In the description to follow, the side where the front cover 7 is provided is "front" and the opposite side is "rear." The front in the sheet thickness direction in FIG. 1 is the left and the back in the sheet thickness direction in FIG. 1 is the right. The left and right direction (side to side direction) is synonymous with the width direction.

(2) Sheet Feed Unit

The sheet feed unit 3 includes a sheet feed tray 9, a sheet feed roller 10, a sheet powder removing roller 12, a pair of registration rollers 14, and a sheet press plate 15. The sheet feed roller 10 is configured to feed a sheet at the top of stack of sheets placed on the sheet press plate 15 one by one at one time. The sheet 8 fed by the sheet feed roller 10 passes through the sheet powder removing roller 12 and the registration rollers 14 and then is conveyed to a transfer position (described later) of the image forming unit 4.

(3) Image Forming Unit

The image forming unit 4 includes a scanner unit 16, the process cartridge 17, and a fixing unit 18.

(3-1) Scanner Unit

The scanner unit 16 is provided in an upper portion of the main body casing 2 and includes a laser beam emission unit (not shown), a rotated polygon mirror 19, a plurality of lenses 20, and a plurality of reflecting mirrors 21. A laser beam emitted from the laser beam emission unit based on image data is reflected on the polygon mirror 19 and then passes through the lenses 20 and reflected on the reflecting mirrors 21. Thereafter, the laser beam is scanned over the surface of a photoconductive drum 25 serving as an example of a rotation body (described later) of the process cartridge 17, as indicated by the dashed line in FIG. 1.

(3-2) Process Cartridge

The process cartridge 17 is detachably attachable to the main body casing 2 and is placed below the scanner unit 16 in the main body casing 2 when the process cartridge 17 is attached to the main body casing 2.

The process cartridge 17 includes the drum cartridge 22 and the developer cartridge 31. The developer cartridge 31 is detachably attachable to a cartridge storing portion 33 of the drum cartridge 22. The drum cartridge 22 and the developer cartridge 31 are an example of a cartridge.

The drum cartridge 22 has a substantially box shape as shown in FIG. 3. The drum cartridge 22 includes a drum frame 23 forming the contour of the drum cartridge. A roughly rear side half of the drum frame 23 is adopted as a drum storing portion 32 and a roughly front side half is adopted as the cartridge storing portion 33.

The drum storing portion 32 has a substantially box shape with an opening formed through both front and rear side faces and includes the photoconductive drum 25, a scorotron charger 26, and a transfer roller 27. An opening formed through the rear face of the drum storing portion 32 is called a drum rear opening 77 and an opening formed through the front face of the drum storing portion 32 is called a drum front opening 63. Each of the drum rear opening 77 and the drum front opening 63 has a substantially rectangle relatively long in the width direction.

The photoconductive drum 25 is relatively long in the width direction and is placed so that it is partially exposed from the drum frame 23 to the rear in the drum rear opening 77. The portion exposed from the drum rear opening 77 in the photoconductive drum 25 is called a drum exposure portion 75 as an example of an exposure portion. The photoconductive drum 25 is rotatably supported on the drum frame 23. The scorotron charger 26 is supported on the drum frame 23 with a spacing from the photoconductive drum 25 above the photoconductive drum 25. The transfer roller 27 is placed facing the photoconductive drum 25 from below the photoconductive drum 25 and is rotatably supported on the drum frame 23.

The cartridge storing portion 33 is formed to have a closed-end frame with the upper face opened. A drum grip 24 extending to the front is formed in the upper end portion of the front end portion of the cartridge storing portion 33. By grasping the drum grip 24, the user can attach or detach the drum cartridge 22 to or from the main body casing 2 singly or as the process cartridge 17 with the developer cartridge 31 attached to the cartridge storing portion 33. The drum front opening 63 of the drum storing portion 32 is exposed in the cartridge storing portion 33, and the front portion of the photoconductive drum 25 is exposed to the inside of the cartridge storing portion 33 through the drum front opening 63. The upper registration roller 14 of the paired registration rollers 14 described above is rotatably supported on the bottom of the cartridge storing portion 33.

The developer cartridge 31 is detachably attached to the drum cartridge 22 in the cartridge storing portion 33.

The developer cartridge 31 has a substantially box shape. The developer cartridge 31 includes a developing frame 28 as an example of a case forming the contour of the developer cartridge 31. An opening (called a developing opening 59) of almost the same shape as the drum front opening 63 is formed through the rear face of the developing frame 28. The inside of the developing frame 28 is partitioned into a toner storage chamber 29 on the front and a developing chamber 30 on the rear. The toner storage chamber 29 and the developing chamber 30 communicate with each other. A developing grip 35 extending to the front is formed in the upper end portion of the front end portion of the developing frame 28. By grasping the developing grip 35, the user can attach or detach the developer cartridge 31 to or from the drum cartridge 22.

The developing chamber 30 includes a supply roller 36, a developing roller 37 as an example of a developer carrier, and a layer thickness regulation blade 38.

The developing roller 37 is relatively long in the width direction and is placed so that the developing roller 37 is partially exposed from the developing frame 28 to the rear in the developing opening 59. The portion exposed from the developing opening 59 in the developing roller 37 is called a developing exposure portion 76 as an example of an exposure portion. The developing opening 59 and the drum front opening 63 face each other in a state where the developer cartridge 31 is attached to the drum cartridge 22. In this state, the developing roller 37 is in contact with the photoconductive drum 25 from the front in the developing exposure portion 76. The developing roller 37 and the supply roller 36 are rotatably supported on the developing frame 28. Both end portions in the width direction of the rotation shaft of the developing roller 37 are exposed from both side walls in the width direction of the developing frame 28. The layer thickness regulation blade 38 includes a plate spring member 45 formed like a thin plate and press contact rubber 46 provided in a lower end portion of the plate spring member 45. An upper end portion of the plate spring member 45 is fixed to the developing frame 28 and the press contact rubber 46 presses the surface of the developing roller 37 by the elastic force of the plate spring member 45.

An agitator is rotatably provided in the toner storage chamber 29. Nonmagnetic single-component toner having positive electrostatic property as an example of a developer is stored in the toner storage chamber 29.

The toner in the toner accommodation chamber 29 is agitated by rotation of the agitator 40 and is released into the developing chamber 30 and is supplied to the supply roller 36, as shown in FIG. 1. The toner supplied to the supply roller 36 is supplied to the developing roller 37 by rotation of the supply roller 36. At this time, the toner is frictionally charged to the positive polarity between the supply roller 36 and the developing roller 37. Subsequently, the toner supplied to the developing roller 37 enters the nip between the press contact rubber 46 and the developing roller 37 with rotation of the developing roller 37 and is carried on the surface of the developing roller 37 as a thin layer while the layer thickness is regulated between the press contact rubber 46 and the developing roller 37.

The surface of the photoconductive drum 25 is positively charged uniformly by the scorotron charger 26 with rotation of the photoconductive drum 25 and then is exposed to light by a laser beam from the scanner unit 16 and an electrostatic latent image based on the image data is formed. Next, when the toner carried on the surface of the developing roller 37 faces the photoconductive drum 25 and comes in contact therewith by rotation of the developing roller 37, the toner is supplied to the electrostatic latent image formed on the surface of the photoconductive drum 25. Accordingly, the electrostatic latent image is developed (is made visible) and the toner image is carried on the surface of the photoconductive drum 25. The toner image is transferred onto the sheet 8 conveyed to the nip between the photoconductive drum 25 and the transfer roller 27 (transfer position). The sheet 8 onto which the toner image is transferred is conveyed to the fixing unit 18.

(3-3) Fixing Unit

The fixing unit 18 is provided at the rear of the process cartridge 17. The fixing unit 18 includes a heating roller 48, a pressurization roller 49 pressed against the heating roller 48 from below, and a pair of conveying rollers 50 placed at the rear of them.

In the fixing unit 18, the toner transferred onto the sheet 8 at the transfer position is thermally fixed while the sheet 8 passes through the nip between the heating roller 48 and the pressurization roller 49 and then the sheet 8 is conveyed to the sheet discharge unit 5 by the pair of conveying rollers 50.

(4) Sheet Discharge Unit

The sheet discharge unit 5 includes a sheet discharge path 51, a sheet discharge roller 52, and a sheet discharge tray 53. The sheet 8 conveyed from the fixing unit 18 to the sheet discharge path 51 is conveyed from the sheet discharge path 51 to the sheet discharge roller 52 and is discharged onto the sheet discharge tray 53 by the sheet discharge roller 52.

2. Details of Main Body Casing and Drum Cartridge (1) Main Body Casing

In the main body casing 2, a guide wall 39 extending substantially along the back and forth direction is provided slightly above the process cartridge 17 attached to the main body casing 2. The lower face of the guide wall 39 is partitioned by a horizontal portion 41 and an inclined portion 42. The inclined portion 42 is a slope extending downward to the slanting rear from the opening 6 to the inside of the main body casing 2, and the front end corresponds to the upper end of the opening 6. The horizontal portion 41 is a substantially horizontal plane extending from the rear end of the inclined portion 42 to the rear along the back and forth direction (or slightly downward inclined). A main body terminal 54 as an example of a first terminal is provided in the vicinity of the rear end of the horizontal portion 41. The main body terminal 54 is formed of an electrical conductive plate spring having elasticity or the like and projects downward from the horizontal portion 41. The main body terminal 54 is connected to a CPU (not shown) provided in the main body casing 2.

(2) Drum Cartridge

The drum cartridge 22 includes a drum cover 44 as an example of a cover member on the rear face of the drum frame 23 (drum storing portion 32).

The drum cover 44 is formed like a thin plate having a substantially inverted-J shape in the left sectional view, for example, as shown in FIG. 3. For the convenience of the description, the upper flat portion of the drum cover 44 is called as a flat portion 47 and the lower bent portion of the drum cover 44 is called as a bend portion 55. The bend portion 55 is bent downward in a direction toward the rear face of the drum frame 23 (namely, the front in FIG. 3). In the drum cover 44, a memory device 64 and a drum terminal 65 as an example of a second terminal electrically connected to the memory device 64 are provided on a side face on the opposite side to the side opposed to the rear face of the drum frame 23 (namely, the rear face in FIG. 3). The memory device 64 is memory for storing information concerning the drum cartridge 22 (for example, drive condition of the photoconductive drum 25, etc.,) in such a manner that the information can be read and can be written. The memory device 64 and the drum terminal 65 may be formed in one piece, i.e., the drum terminal 65 may be integrated with the memory device 64. The memory device 64 may be provided in the drum frame 23 rather than the drum cover 44. In this case, the memory device 64 is electrically connected to the drum terminal 65 of the drum cover 44 by an electric wire or a plate.

A swing shaft 56 extending in the width direction is inserted into the drum cover 44. The drum cover 44 is supported in the rear end portion of the upper wall of the drum frame 23 through the swing shaft 56 and swingable around the swing shaft 56 (see FIG. 1). In particular, the drum cover 44 can move between a cover position (an example of a first position) and an exposure position (an example of a second position) described later. The swing shaft 56 is roughly at the center position in the up and down direction of the flat portion 47; hereinafter, in the flat portion 47, the portion above the swing shaft 56 will be referred as an upper portion 57 and the portion below the swing shaft 56 will be referred as a lower portion 58.

When the drum cover 44 is positioned at the cover position, the lower end portion of the bend portion 55 abuts the rear end portion of the bottom wall of the drum frame 23 from the rear, and the drum cover 44 covers the drum rear opening 77 formed through the drum frame 23 and the drum exposure portion 75 exposed from the drum rear opening 77 from the rear, as indicated by the solid line in FIG. 2. At this time, the drum cover 44 is made upright roughly along the up and down direction so that the upper portion 57 projects upward to the slanting front from the upper wall of the drum frame 23. The drum terminal 65 faces backward.

On the other hand, when the drum cover 44 is positioned at the exposure position, the lower end portion of the bend portion 55 is away from the rear end portion of the bottom wall of the drum frame 23 to the rear and the drum cover 44 exposes the drum rear opening 77 and the drum exposure portion 75 to the rear, as shown in FIG. 1. The drum cover 44 is inclined roughly along the back and forth direction so that the flat portion 47 is almost along the upper wall of the drum frame 23. When the drum cover 44 is positioned at the exposure position, the drum terminal 65 faces upward.

Thus, the drum cover 44 can move relative to the drum frame 23.

A spring 66 (an example of an urging member) is intervened between the rear end portion of the upper wall of the drum frame 23 and the upper portion 57 of the drum cover 44 for urging the upper portion 57 of the drum cover 44 so as to project upward from the upper wall of the drum frame 23, as shown in FIG. 2. Accordingly, the drum cover 44 is urged so as to position at the cover position normally (namely, when the drum cartridge 22 is outside the main body casing 2). The drum cover 44 protects the drum exposure portion 75 of the photoconductive drum 25 in a state where it positions at the cover position.

(3) Attaching and Detaching of Process Cartridge to and from Main Body Casing

The drum cartridge 22 including the drum cover 44 is attached to the main body casing 2. For the convenience of the description, the description shows an example where the drum cartridge 22 to which the developer cartridge 31 is attached, namely, the process cartridge 17 is attached to the main body casing 2, rather than the drum cartridge 22 is solely attached to the main body casing 2. However, the drum cartridge 22 solely may also be attached to and detached from the main body casing 2. The drum cover 44 is positioned at the cover position when attachment of the process cartridge 17 is started.

First, the front cover 7 is opened for opening the opening 6 and the process cartridge 17 is inserted into the main body casing 2 from the front roughly along the horizontal direction. At this time, the upper portion 57 of the drum cover 44 at the cover position is opposed to the inclined portion 42 of the guide wall 39 with a spacing in the back and forth direction. Thus, if the process cartridge 17 is continuously inserted into the main body casing 2 roughly along the horizontal direction, the upper portion 57 is abutted against the inclined portion 42. Accordingly, the drum cover 44 starts to swing toward the exposure position against the urging force of the spring 66 (see the drum cover 44 indicated by the dotted line in FIG. 2). If the process cartridge 17 is continuously inserted into the main body casing 2 roughly along the horizontal direction, the upper portion 57 is abutted against the horizontal portion 41 following the inclined portion 42 and the drum cover 44 swings to the exposure position (see the drum cover 44 indicated by the alternate long and short dash line in FIG. 2). Since the horizontal portion 41 is a roughly horizontal plane as described above, the drum cover 44 is maintained at the exposure position while the upper portion 57 is abutted against the horizontal portion 41. When inserting of the process cartridge 17 into the main body casing 2 stops, placing the process cartridge 17 in the main body casing 2 is complete as shown in FIG. 1. At this time, the drum cover 44 is positioned at the exposure position and thus the drum terminal 65 faces upward as described above and abuts the main body terminal 54. Accordingly, the drum terminal 65 and the main body terminal 54 are electrically connected, so that the CPU (not shown) and the memory device 64 provided in the main body casing 2 are electrically connected. In this state, the CPU (not shown) can read the information stored in the memory device 64 and can rewrite the information stored in the memory device 64 in response to the image formation operation.

On the other hand, the front cover 7 is opened in a state where the process cartridge 17 is attached to the main body casing 2, and the process cartridge 17 is drawn out to the front. Accordingly, the drum terminal 65 is brought away from the main body terminal 54 and thereby electrically disconnected from the main body terminal 54. The drum cover 44 is continuously at the exposure position as indicated by the alternate long and short dash line in FIG. 2 in a state where the upper portion 57 is abutted against the horizontal portion 41. When the process cartridge 17 is drawn out to the front and the upper portion 57 passes through the horizontal portion 41 and is abutted against the inclined portion 42, the drum cover 44 starts to swing toward the cover position by the urging force of the spring 66 (see the drum cover 44 indicated by the dotted line in FIG. 2). When the upper portion 57 passes through the inclined portion 42, the drum cover 44 swings to the cover position. When the process cartridge 17 is completely drawn out from the main body casing 2, detaching the process cartridge 17 from the main body casing 2 is complete.

3. Function and Effect of the Embodiment

As shown in FIG. 1, when the drum cover 44 is moved in one direction (in particular, to the exposure position) at the attachment completion position of the process cartridge 17 (in particular, the drum cartridge 22) in the main body casing 2, the drum terminal 65 provided on the drum cover 44 abuts the main body terminal 54. Then, the drum terminal 65 and the main body terminal 54 are electrically connected and information can be transferred between the memory device 64 and the CPU (not shown) provided in the main body casing 2.

When the drum terminal 65 abuts the main body terminal 54, the abutment pressure received by the drum terminal 65 from the main body terminal 54 is received at the drum cover 44, so that the abutment pressure can be prevented from acting directly on the drum frame 23 and the drum frame 23 can be prevented from moving from a predetermined attachment completion position. Thus, shift of the attachment position of the process cartridge 17 (drum cartridge 22) relative to the main body casing 2 can be prevented.

Consequently, positioning the process cartridge 17 to the main body casing 2 can be reliably executed without affecting connection of the main body terminal 54 and the drum terminal 65.

The drum cover 44 can move between the cover position for covering the drum exposure portion 75 of the photoconductive drum 25 (see the solid line portion in FIG. 2) and the exposure position for exposing the drum exposure portion 75 (see FIG. 1). Thus, when the drum cover 44 is moved to the exposure position, a toner image can be transferred from the photoconductive drum 25 to a sheet 8, and the sheet 8 with the toner image can pass through the drum rear opening 77 uncovered with the drum cover 44. On the other hand, when the drum cover 44 is moved to the cover position, the drum exposure portion 75 can be protected (see FIG. 2). Thus, the photoconductive drum 25 as a rotation body rotatably supported on the drum frame 23 is covered with the drum cover 44 at the cover position.

When the drum cover 44 is positioned at the exposure position, the drum terminal 65 abuts the main body terminal 54 and thus information can be transferred between the memory device 64 and the CPU (not shown) in the main body casing 2 at the same time as the transfer operation described above, so that operability can be improved.

4. Modified Examples (1) Modified Example 1

A developing cover 60 may be provided as an example of a cover member in addition to or in place of the drum cover 44. The developer cartridge 31 and the drum cartridge 22 when the developing cover 60 is provided will be discussed below.

Figure 4:
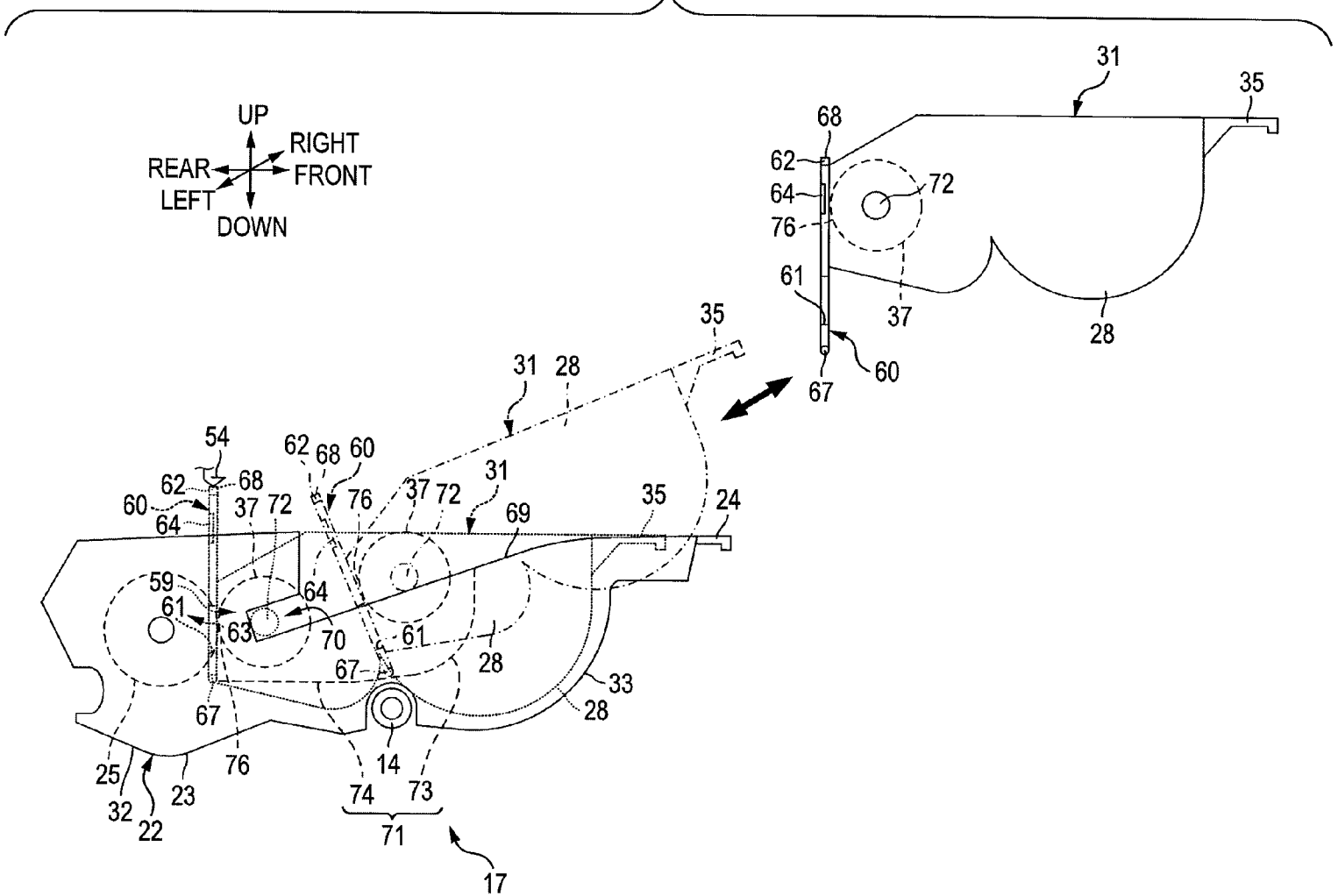
FIG. 4 is a side view of the process cartridge in which a developer cartridge is attached to and detached from a drum cartridge.
Figure 5A:
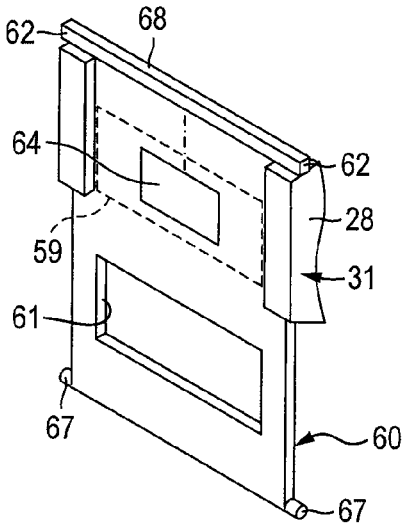
FIGS. 5A and 5B are perspective views of a developer cover.

FIG. 4 is a side view of the process cartridge in which the developer cartridge is attached to and detached from the drum cartridge. FIG. 5A shows the developing cover positioned at a cover position and FIG. 5B shows the developing cover positioned at an exposure position.

(1-1) Developing Cartridge

Figure 5B:
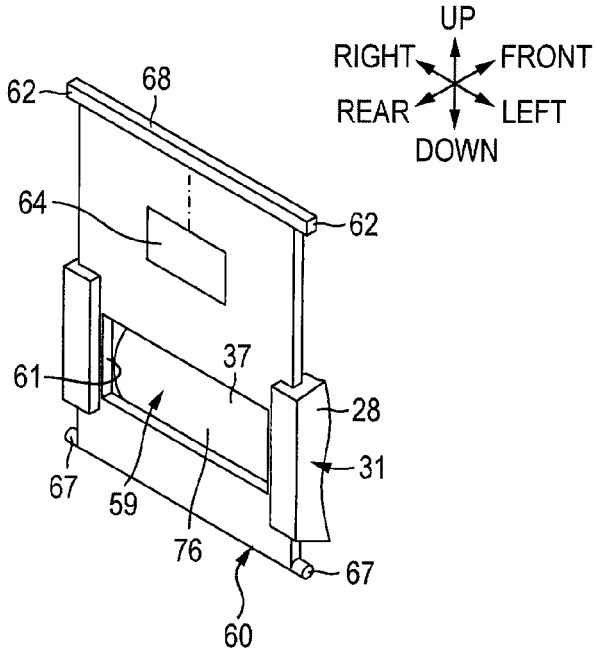

The developing cover 60 is included in the developer cartridge 31 and is formed like a thin plate relatively long in an up and down direction and roughly rectangular in the front view, for example, as shown in FIGS. 5A and 5B. The upper end portion and the lower end portion of the developing cover 60 are formed so as to project one step to both sides in the width direction. The portions projecting to both sides in the width direction in the upper end portion of the developing cover 60 are called upper projection portions 62 (an example of a distal end portion), and the portions projecting to both sides in the width direction in the lower end portion of the developing cover 60 are called lower projection portions 67. In the developing cover 60, a through hole 61 of almost the same shape as the developing opening 59 is formed at a position slightly shifted to the lower side from the center of the developing cover 60 in the up and down direction thereof.

The developing cover 60 is slidably supported in the up and down direction by the rear end portions of both side walls in the width direction of the developing frame 28. In particular, the portion of the developing cover 60 between the upper projection portions 62 and the lower projection portions 67 in the up and down direction is sandwiched between the rear end portions of both side walls in the width direction of the developing frame 28. In this state, the developing cover 60 can move between a cover position described later and an exposure position above the cover position.

When the developing cover 60 is positioned at the cover position, the developing opening 59 is covered with the upper portion above the through hole 61 in the developing cover 60 from the rear, as shown in FIG. 5A. Accordingly, the developing exposure portion 76 is also covered with the developing cover 60 from the rear. That is, when the developing cover 60 is positioned at the cover position, the developing cover 60 covers the developing opening 59 formed through the developing frame 28 and the developing exposure portion 76 exposed from the developing opening 59 from the rear. The roughly lower half portion of the developing cover 60 projects downward from the developing frame 28. When the developing cover 60 moves down to the cover position, the upper projection portions 62 abut the rear end portions of both side walls in the width direction of the developing frame 28 from above, so that the developing cover 60 is prevented from further moving from the cover position and dropping out from the developing frame 28. The developing cover 60 is normally positioned at the cover position under its own weight.

On the other hand, when the developing cover 60 is positioned at the exposure position, the developing opening 59 faces the through hole 61 in the back and forth direction and communicates with the through hole 61 as shown in FIG. 5B. Accordingly, the developing exposure portion 76 is exposed to the front through the developing opening 59 and the through hole 61. That is, when the developing cover 60 is positioned at the exposure position, the developing cover 60 exposes the developing exposure portion 76 to the rear. The roughly upper half portion of the developing cover 60 projects upward from the developing frame 28.

Thus, when the developing cover 60 moves from the cover position to the exposure position, the developing cover 60 moves up (an example of a first direction) relative to the developing opening 59; when the developing cover 60 moves from the exposure position to the cover position, it moves down relative to the developing opening 59. This means that the developing cover 60 can make a relative movement to the developing frame 28 containing the developing opening 59.

In the developing cover 60, the above-described memory device 64 is provided above the through hole 61 on a side face on the opposite side to the side opposed to the developing opening 59 (namely, the rear face in FIGS. 5A and 5B). The memory device 64 according to modified example 1 stores information concerning the developer cartridge 31 (for example, the toner storage amount, etc.,). A developing terminal 68 as an example of a second terminal electrically connected to the memory device 64 is provided on the upper end face of the developing cover 60. The memory device 64 and the developing terminal 68 may be formed in one piece. The memory device 64 may be provided in the developing frame 28 rather than the developing cover 60. In this case, the memory device 64 is electrically connected to the developing terminal 68 of the developing cover 60 by an electric wire or a plate.

(1-2) Drum Cartridge

As shown in FIG. 4, in the drum cartridge 22, the upper end faces of both side walls of the cartridge storing portion 33 in the width direction thereof (called guide rails 69) are formed so as to incline downward to the slanting rear. The rear end margins of the guide rails 69 are connected roughly to the center in the up and down direction of the front end margins of both side walls of the drum storing portion 32 in the width direction thereof. A concave portion 70 recessed downward to the slanting rear continuous from the rear end margin of the guide rail 69 is formed on both side walls of the drum storing portion 32 in the width direction thereof. Each concave portion 70 pierces the corresponding width direction side wall in the drum storing portion 32 in the width direction.

A guide groove 71 is formed on the width direction inner faces of both side walls of the drum cartridge 22 in the width direction thereof corresponding to the developing cover 60. The guide grooves 71 are formed by notching the width direction inner faces of both side walls of the drum cartridge 22 in the width direction thereof from the upper end margins to the lower side. In particular, the groove bottom (lower end face) of each guide groove 71 is formed so that it extends like a circular arc from the rough center position in the back and forth direction of the corresponding guide rail 69 to the rear lower side (this portion is called a circular arc groove bottom 73) and then extends to the rear roughly horizontally (this portion is called a horizontal groove bottom 74).

(1-3) Attaching and Detaching of Developing Cartridge to and from Drum Cartridge The direction in which the developer cartridge 31 is attached to and detached from the drum cartridge 22 is a direction crossing the horizontal direction (see the thick arrow in FIG. 4).

The developer cartridge 31 with the developing cover 60 at the cover position (see the solid line indication portion in FIG. 4) is inserted into the cartridge storing portion 33 of the drum cartridge 22 downward to the slanting rear. At this time, first, the corresponding lower projection portions 67 are accepted in the guide grooves 71. Portions exposed from both side walls of the developing frame 28 in the width direction thereof in the rotation shaft of the developing roller 37 (called exposure shafts 72) are placed in the corresponding guide rails 69. In this state, if the developer cartridge 31 is inserted into the cartridge storing portion 33, the lower projection portions 67 are guided along the guide grooves 71 (in particular, the circular arc groove bottoms 73), the exposure shafts 72 are guided along the guide rails 69, and the developer cartridge 31 moves downward to the slanting rear. When the lower projection portions 67 pass through the circular arc groove bottoms 73 and arrive at the horizontal groove bottoms 74, the positions of the lower projection portions 67 in the up and down direction are fixed and it is made impossible for the developing cover 60 to further move down. Thus, if the developer cartridge 31 (in particular, the developing frame 28) is further moved down, the developing frame 28 moves down relative to the developing cover 60 of which the downward movement is regulated (see the alternate long and short dash line portion in FIG. 4). Accordingly, the developing cover 60 moves up relative to the developing frame 28 and moves to the exposure position.

When the exposure shafts 72 pass through the corresponding guide rails 69 and are fitted into the corresponding concave portions 70, placing the developer cartridge 31 in the drum cartridge 22 is complete (see the dotted line portion in FIG. 4). At this time, the through hole 61 of the developing cover 60 at the exposure position, the developing opening 59, and the drum front opening 63 face each other and the developing exposure portion 76 of the developing roller 37 comes in contact with the photoconductive drum 25. The upper end portion of the developing cover 60, in particular the developing terminal 68 projects upward from each upper wall of the drum frame 23 and the developing frame 28. Thus, if the drum cartridge 22 to which the developer cartridge 31 is attached, namely, the process cartridge 17 is attached to the main body casing 2, the developing terminal 68 abuts the main body terminal 54. Accordingly, the CPU (not shown) provided in the main body casing 2 and the memory device 64 are electrically connected and the CPU (not shown) can read and rewrite the information stored in the memory device 64 as described above. If the process cartridge 17 is detached from the main body casing 2, the developing terminal 68 is brought away from the main body terminal 54 and thereby electrically disconnected from the main body terminal 54.

On the other hand, when the developer cartridge 31 attached to the drum cartridge 22 is drawn out to the front, the developer cartridge 31 moves up to the slanting front. At this time, the lower projection portions 67 are guided along the guide grooves 71 (in particular, the horizontal groove bottoms 74) and the exposure shafts 72 are placed out of the concave portions 70 and are guided along the guide rails 69. The developing cover 60 cannot move up under its own weight; whereas, the developing frame 28 moves up and thus the developing cover 60 moves down relative to the developing frame 28 and moves to the cover position. When the exposure shafts 72 are placed out of the guide rails 69 and the lower projection portions 67 are placed out of the guide grooves 71 (in particular, the circular arc groove bottoms 73) and the developer cartridge 31 is completely drawn out from the cartridge storing portion 33, detaching the developer cartridge 31 from the drum cartridge 22 is complete.

(1-4) Function and Effect of Modified Example 1

In modified example 1, the developing cover 60 can move between the cover position for covering the developing exposure portion 76 of the developing roller 37 (see FIG. 5A) and the exposure position for exposing the developing exposure portion 76 (see FIG. 5B). Thus, if the developing cover 60 is moved to the exposure position, toner can be supplied from the developing exposure portion 76 to the photoconductive drum 25 (see the dotted line portion in FIG. 4) and if the developing cover 60 is moved to the cover position, the developing exposure portion 76 can be protected (see the solid line portion in FIG. 4). Thus, the developing roller 37 as a rotation body rotatably supported on the developing frame 28 is covered with the developing cover 60 at the cover position.

When the developing cover 60 is positioned at the exposure position, the developing terminal 68 abuts the main body terminal 54 and thus information can be transferred between the memory device 64 and the CPU (not shown) in the main body casing 2 at the same time as the toner supply described above, so that operability can be improved.

(2) Modified Example 2

In the embodiment described above, as the process cartridge 17, the drum cartridge 22 and the developer cartridge 31 can be separated. However, the process cartridge 17 into which the drum cartridge 22 and the developer cartridge 31 are combined as one piece may be adopted as an example of a cartridge. In this case, the process cartridge 17 is provided with the drum cover 44, but not with the developing cover 60. As information concerning the process cartridge 17, both the information concerning the drum cartridge 22 described above and the information concerning the developer cartridge 31 are stored in the memory device 64 of the drum cover 44.

In the embodiment described above, the toner storage chamber 29 and the developing chamber 30 are provided in the developing frame 28 of the developer cartridge 31, but the portion corresponding to the toner storage chamber 29 may be attached to and detached from the developing frame 28 as a toner cartridge.

The developer cartridge 31 may also be detachably attachable to the drum cartridge 22 in a state where the drum cartridge 22 is attached to the main body casing 2. The photoconductive drum 25, the scorotron charger 26, and the transfer roller 27 may be provided in the main body casing 2 and the developer cartridge 31 may be detachably attachable to the main body casing 2.

(3) Modified Example 3

In the embodiment described above, the monochrome laser printer 1 is illustrated; however, for example, the image forming device can also be implemented as a color laser printer (containing tandem type, intermediate transfer type).

What is claimed is:

1. A cartridge detachably attachable to a main body including a first terminal, said cartridge comprising:

a case;

a memory device configured to store information concerning the cartridge;

a cover member configured to cover a part of the case and movably supported on the case to allow a relative movement to the case; and a second terminal provided on the cover member and electrically connected to the memory device, wherein, in a state where the cartridge is attached to the main body, the second terminal contacts with the first terminal of the main body.

2. The cartridge according to claim 1, wherein the cover member is configured to move between a first position and a second position relative to the case, wherein the cover member covers the part of the case when the cover member is positioned at the first position, and wherein, in the state where the cartridge is attached to the main body, the cover member is positioned at the second position.

3. The cartridge according to claim 2, wherein, when the cover member is positioned at the second position, the cover member exposes the part of the case.

4. The cartridge according to claim 2, further comprising a photoconductor supported on the case and partially exposed from the case, the photoconductor on which an electrostatic latent image is allowed to be formed, wherein, when the cover member is positioned at the first position, the photoconductor is covered with the cover member, and wherein, when the cover member is positioned at the second position, the photoconductor is uncovered.

5. The cartridge according to claim 4, wherein a developer image is allowed to be formed on the photoconductor based on the electrostatic latent image, wherein, the cover member moves to the second position to allow the developer image to be transferred to a recording medium.

6. The cartridge according to claim 4, wherein the second terminal is contactable with the first terminal when the cover member is positioned at the second position.

7. The cartridge according to claim 2, further comprising a developer carrier supported on the case and partially exposed from the case, a developer being allowed to be carried on a surface of the developer carrier, wherein, when the cover member is positioned at the first position, the developer carrier is covered with the cover member, and wherein, when the cover member is positioned at the second portion, the developer carrier is uncovered.

8. The cartridge according to claim 7, wherein, when the cover member is positioned at the second position, the developer carried on the developer carrier is allowed to be supplied from a portion of the developer carrier uncovered with the cover member to an electrostatic latent image formed on a photoconductor.

9. The cartridge according to claim 7, wherein the second terminal is contactable with the first terminal when the cover member is positioned at the second position.

10. The cartridge according to claim 2, further comprising an urging member attached to the case and the cover member and configured to apply an urging force to the cover member in a direction toward the first position.

11. The cartridge according to claim 10, wherein the cover member has a first portion, and wherein, in the state where the cartridge is attached to the main body, the first portion of the cover member contacts with the main body and is subjected to a force from the main body against the urging force of the urging member.

12. The cartridge according to claim 11, wherein the urging member is attached to the first portion of the cover member.

13. The cartridge according to claim 11, wherein the cover member is supported on the case and rotatable around an axis.

14. The cartridge according to claim 13, wherein the cover member has a second portion opposite to the first portion with respect to the axis, and wherein the second terminal is provided at the second portion.

15. The cartridge according to claim 2, wherein the cover member is supported on the case and slidable along a first direction relative to the case.

16. The cartridge according to claim 15, wherein a position of the cover member is changed from the first position to the second position in the first direction, wherein the second terminal is provided at a distal end portion of the cover member toward the first direction.

17. The cartridge according to claim 1, wherein the cartridge is detachably mountable to a second cartridge.

18. The cartridge according to claim 17, wherein the cover member has a first portion, and wherein, in the state where the cartridge is attached to the second cartridge, the first portion of the cover member contacts with the second cartridge and is subjected to a force from the second cartridge.

19. The cartridge according to claim 1, wherein the second terminal is integrated with the memory device.

20. An image forming device comprising:

a first terminal; and a main body to which a cartridge is detachably attachable, wherein the cartridge comprises:

a case;

a memory device configured to store information concerning the cartridge;

a cover member configured to cover a part of the case and movably supported on the case to allow a relative movement to the case; and a second terminal provided on the cover member and electrically connected to the memory device, wherein, in a state where the cartridge is attached to the main body, the first terminal contacts with the second terminal of the cartridge.

* * * * *